United States Patent [19]

Glennon

[11] Patent Number: 4,624,463

[45] Date of Patent: Nov. 25, 1986

[54] PROCEDURE AND RULES FOR PLAYING INDY CLASS 500

[76] Inventor: Kenneth W. Glennon, 365 N. Wilson St., Hobart, Ind. 46342

[21] Appl. No.: 596,924

[22] Filed: May 24, 1984

[51] Int. Cl.[4] ..... A63F 3/00

[52] U.S. Cl. ..... 273/246

[58] Field of Search ..... 273/246, 249, 248, 243

[56] References Cited

U.S. PATENT DOCUMENTS

| | | | |
|---|---|---|---|
| 1,544,591 | 7/1925 | Murray | 273/246 |
| 1,635,734 | 7/1927 | Ziegler | 273/248 |
| 3,690,666 | 9/1972 | Seitz | 273/246 |
| 3,738,659 | 6/1973 | Partridge | 273/246 |
| 4,124,214 | 11/1978 | Pavis | 273/249 |
| 4,264,076 | 4/1981 | Duncan | 273/246 |
| 4,315,627 | 2/1982 | Schlegel et al. | 273/249 |

FOREIGN PATENT DOCUMENTS

| | | | |
|---|---|---|---|
| 1417646 | 12/1975 | United Kingdom | 273/246 |

*Primary Examiner*—Richard C. Pinkham
*Assistant Examiner*—Benjamin Layno

[57] ABSTRACT

Indy Class 500 is a board game for entertainment. Two or more players may participate in the game. The physical limit of participants is eight players. The object of the game is for one of the participants to be first in completing twenty laps around the game board course. Obstructions are provided in the game to cause participants uncalculable obstacles in completing the twenty laps. The game board identifies the participants actions. It is divided into twenty five numbered sections. Each section instructs the participant in what to do. Each participant selects a small race car facsimile which is used as his marker. The markers are advanced in turn by throwing of dice, which determines the number of sections the participants may advance. The game also educates the participants with historical facts relating to motor racing.

7 Claims, 10 Drawing Figures

RECORD SHEET

FIG 8 A

| YEAR 36 | WINNER 37 | CAR NAME 38 | SPEED 39 | SECOND PLACE 40 |
|---|---|---|---|---|
| 1985 | | | | |
| 1984 | | | | |
| 1983 | Tom Sneva | March Cosworth | 162.117 | Al Unser Sr. |
| 1982 | Gordon Johncock | STP | 162.029 | Rick Mears |
| 1981 | Bobby Unser | Norton Spirit | 139.084 | Mario Andretti |
| 1980 | Johnny Rutherford | Penzoil | 142.862 | Tom Sneva |
| 1979 | Rick Mears | Gould Charge | 158.899 | A.J. Foyt |
| 1978 | Al Unser | Chaparral Lola | 161.363 | Tom Sneva |
| 1977 | A.J. Foyt | Gilmore Racing | 161.331 | Tom Sneva |
| 1976 | Johnny Rutherford | McLaren | 148.725 | A.J. Foyt |
| 1975 | Bobby Unser | Jorgensen Eagle | 142.213 | Johnny Rutherford |
| 1974 | Johnny Rutherford | McLaren | 158.58 | Johnny Rutherford |
| 1973 | Gordon Johncock | STP | 159.03 | Billy Vukovich |
| 1972 | Mark Donohue | Sunoco McLaren | 162.96 | Al Unser |
| 1971 | Al Unser | Johnny Lightning Spl. | 157.73 | Peter Revson |
| 1970 | Al Unser | Johnny Lightning 500 Spl. | 155.74 | Mark Donohue |
| 1969 | Mario Andretti | STP Oil Special | 156.86 | Dan Gurney |
| 1968 | Bobby Unser | Rislone Special | 152.88 | Dan Gurney |
| 1967 | A.J. Foyt | Sheraton Thompson Spl. | 151.20 | Al Unser |
| 1966 | Graham Hill | American Red Ball Spl. | 144.31 | Jimmy Clark |
| 1965 | Jim Clark | Lotus Ford | 150.68 | Parnelli Jones |
| 1964 | A.J. Foyt | Sheraton Thompson Spl. | 147.35 | Roger Ward |
| 1963 | Parnelli Jones | Agajanian Willard Spl. | 143.13 | Jim Clark |
| 1962 | Roger Ward | Leader Card 500 Spl. | 140.29 | Len Sutton |
| 1961 | A.J. Foyt | Bowens Seal Fast Spl. | 139.13 | Eddie Sachs |
| 1960 | Jim Rathmann | Ken Paul Special | 138.76 | Roger Ward |
| 1959 | Roger Ward | Leader Card 500 Spl. | 135.85 | Jim Rathman |
| 1958 | Jimmy Bryan | Belond AP Special | 133.79 | George Amik |
| 1957 | Sam Hanks | Belond Exhaust Spl. | 135.60 | Jim Rathman |
| 1956 | Pat Flaherty | John Zink Special | 128.49 | Sam Hanks |
| 1955 | Bob Sweikert | John Zink Special | 128.20 | Tony Bettenhausen |
| 1954 | Bill Vukovich | Fuel Injection Spl. | 130.84 | Jimmy Bryan |
| 1953 | Bill Vukovich | Fuel Injection Spl. | 128.74 | Art Cross |
| 1952 | Troy Ruttman | Agajanian Spl. | 128.92 | Jim Rathman |

41

42

FIG 8B

| | | | | |
|---|---|---|---|---|
| 1951 | Lee Wallard | Belanger Spl. | 126.24 | Mike Nazaruk |
| 1950 | Johnny Parsons | Wynns Friction Proofing | 124.00 | Bill Holland |
| 1949 | Bill Holland | Blue Crown Spark Plug Spl. | 121.32 | Johnny Parsons |
| 1948 | Mauri Rose | Blue Crown Spark Plug " | 119.81 | Bill Holland |
| 1947 | Mauri Rose | Blue Crown Spark Plug " | 116.33 | Bill Holland |
| 1946 | Geo. Robson | Thorne Eng. Spl. | 114.82 | Jimmy Jackson |
| 1941 | Mauri Rose & Floyd Davis | Noc-out Hose Clamp Spl. | 115.11 | Rex Mays |
| 1940 | Wilbur Shaw | Boyle Spl. | 114.27 | Rex Meyers |
| 1939 | Wilbur Shaw | Boyle Spl. | 115.03 | Jimmy Snyder |
| 1938 | Floyd Roberts | Burd Piston Ring Spl. | 117.20 | Wilbur Shaw |
| 1937 | Wilbur Shaw | Shaw Gilmore Spl. | 113.58 | Ralph Hepburn |
| 1936 | Louis Meyer | Ring Free Spl. | 109.06 | Ted Horn |
| 1935 | Kelly Petillo | Gilmore Speedway Spl. | 106.24 | Wilbur Shaw |
| 1934 | Wm. Cummings | Boyle Prod. Spl. | 104.86 | Mauri Rose |
| 1933 | Louis Meyer | Tydol Spl. | 104.16 | Wilbur Shaw |
| 1932 | Fred Frame | Miller Hartz Spl. | 104.14 | Howdy Wilcox |
| 1931 | L. Schneider | Bowers Seal Fast Spl. | 96.62 | Fred Frame |
| 1930 | Billy Arnold | Miller Hartz Spl. | 100.44 | Wm. Cantlon |
| 1929 | Ray Keech | Simplex Piston Ring Spl. | 97.58 | Louis Meyer |
| 1928 | Louis Meyer | Miller Special | 99.48 | Lou Moore |
| 1927 | George Souders | Duesenberg | 97.54 | Earl Devore |
| 1926 | F. Lockhart | Miller Spl. | 95.90 | Harry Hartz |
| 1925 | Peter DePalo | Duesenberg | 101.13 | Earl Cooper |
| 1924 | L.L. Corum & Joe Boyer | Duesenberg Spl. | 98.23 | Harry Hartz |
| 1923 | Tommy Milton | H.C.S. Spl. | 90.95 | Harry Hartz |
| 1922 | Jas. A. Murphy | Murphy Spl. | 94.48 | Harry Hartz |
| 1921 | Tommy Milton | Frontenac | 89.62 | Roscoe Sarles |
| 1920 | Gaston Chevrolet | Monroe | 88.62 | Rene Thomas |
| 1919 | Wilcox | Peugot | 88.05 | Hearne |
| 1916 | Resta | Peugot | 84.0 | D'Alene |
| 1915 | R. DePalma | Mercedes | 89.84 | Resta |
| 1914 | Thomas | Delage | 82.47 | Duray |
| 1913 | Goux | Peugot | 75.93 | Wishart |
| 1912 | Dawson | National | 78.72 | Tetzlaff |
| 1911 | Harroun | Marmon | 74.59 | Mulford |

NOTE: No race--1917,1918(W.W.I.) 1942 thru 1945 (W.W.II.)

42

PROCEDURE AND RULES FOR PLAYING INDY CLASS 500

GENERAL DRAWING DESCRIPTION

FIG. 1. is a top plan view of the Indy Class 500 playing board.

FIG. 2. is a perspective view of four each numbered markers representing Indy Class 500 race cars which are moved around the race course during the game.

FIG. 8 is a historical record sheet for reference while playing the game of Indy Class 500.

DESCRIPTION OF A PREFERRED EMBODIMENT

Physical components of the game

Figure 1A:
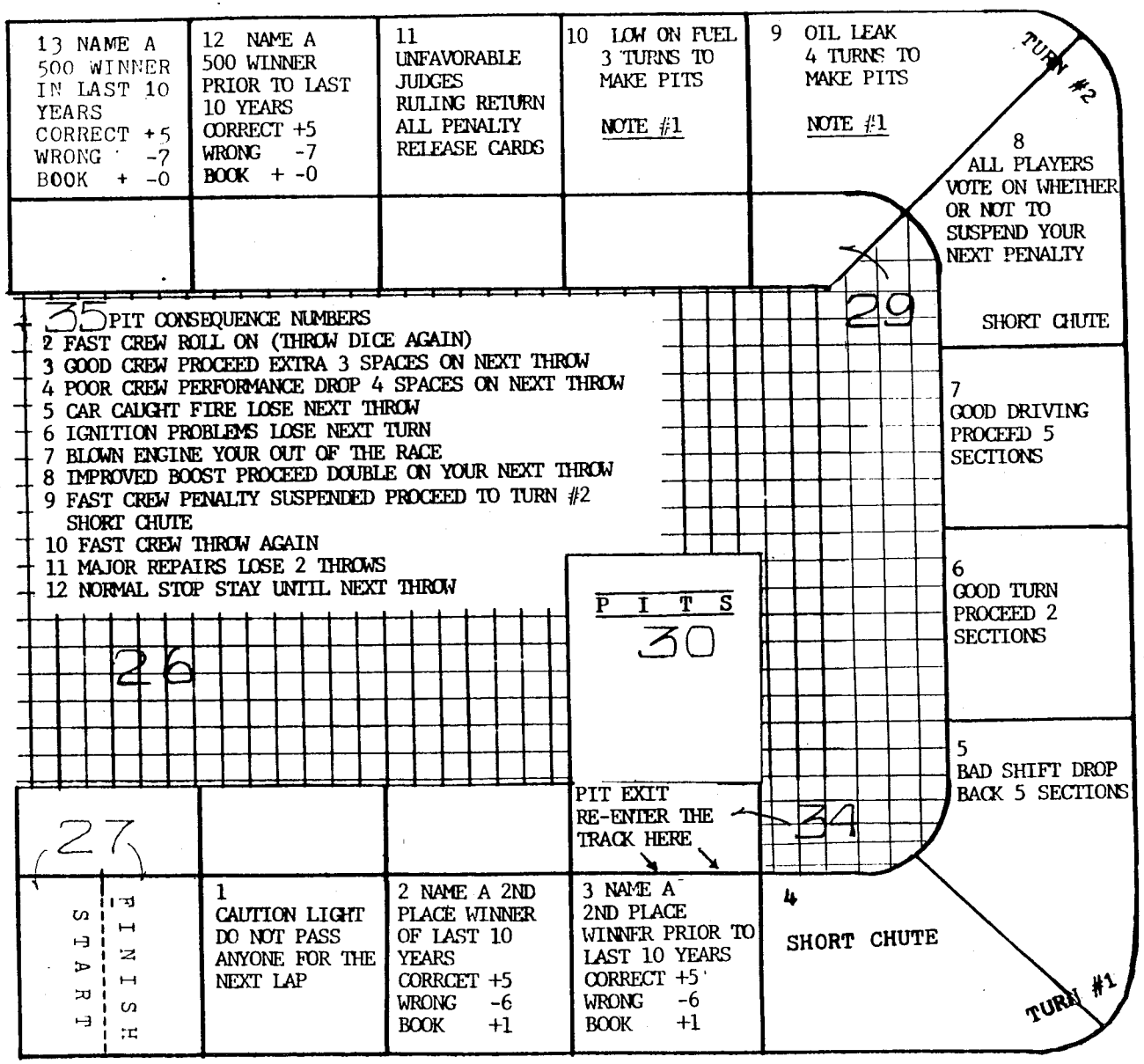
Figure 1B:
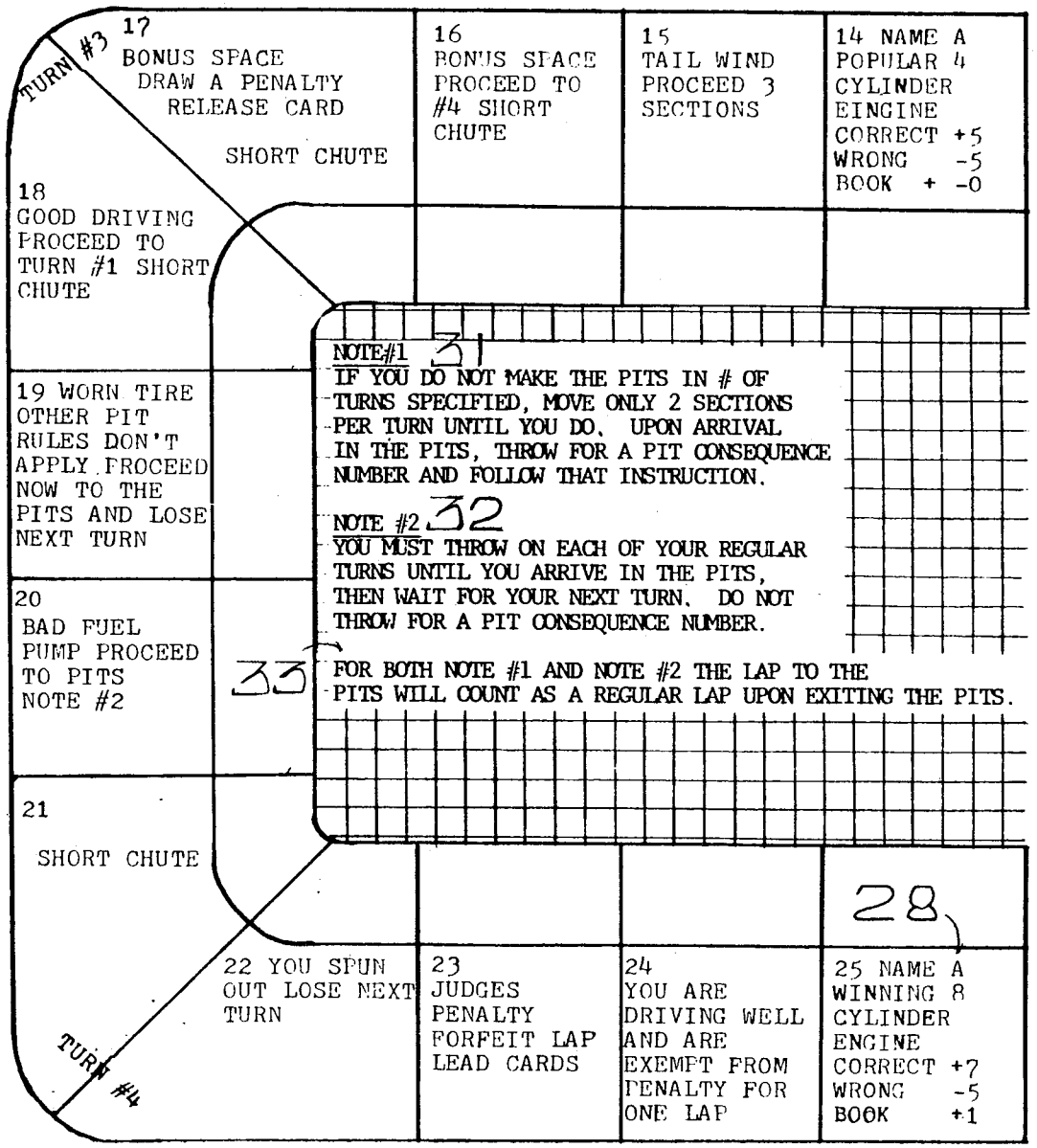

In particular with reference to the drawings in FIG. 1A, and FIG. 1B the numeral 26 identifies the game board upon which is a simulated Indy Class 500 auto race course 28. The auto race course 28 is oval shaped having a plurality of marked sections which are numbered in succession with numbers 1 through 25, and a start finish line 27. On the inner two thirds of the race course 28 is a pit lane 29 which begins on the inside of section 9 and is synchronous with the sections which follow in progression through section 25 and across the inside of the start finish line 27 and across the inside of sections 1 and 2 and then terminates at the pits 30. On the inside portion of the race course 28 and further on the inside of the pit lane 29 are further instruction indicia in the form of NOTE#1 31 and NOTE#2 32 and in addition, a further to NOTE#1 and NOTE#2 at 33. Additionally on the same inside portion of the race course are further various instruction indicia in the form of pit consequence numbers 35.

Figure 3:
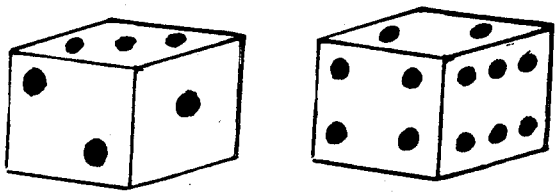
FIG. 3 is a perspective view of dice employed in the game.

In FIG. 3 a pair of dice are illustrated. The dice are used in determining the participants order of play, by way of each player throwing the dice with the player with the highest number playing first, the second highest playing second, and so forth. In addition the dice are used to determine progression, regression, and pit consequence numbers, all of which will be defined later.

Figure 2:
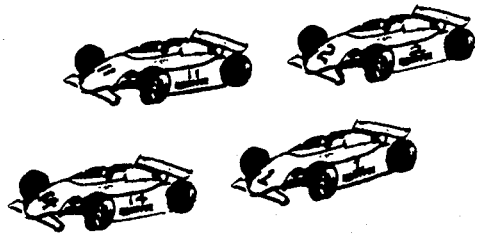

FIG. 2 illustrates a plurality of numbered playing pieces simulating Indy Class 500 racers.

Figure 4:
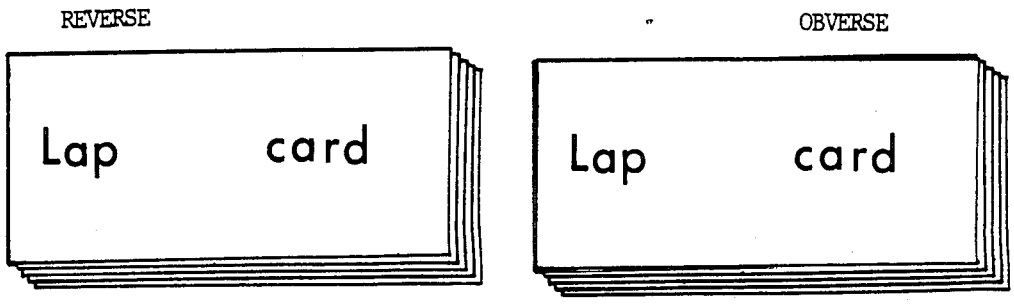
FIG. 4 is a perspective view of a stack of Lap Cards which bear the same obverse and reverse.

FIG. 4 illustrates the obverse and reverse of the lap card.

Figure 5:
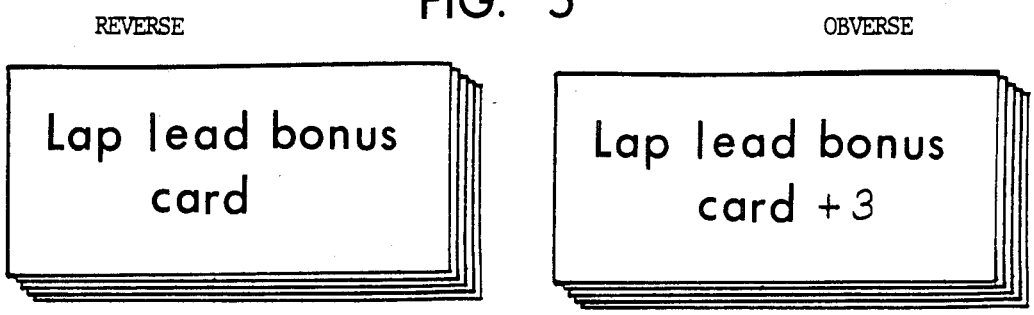
FIG. 5 is a perspective view of a stack of Lap Lead Bonus Cards which bear a differing obverse and reverse.

FIG. 5 illustrates the obverse and reverse of the lap lead bonus card. The bonus laps indicated on the obverse side of the lap lead bonus card FIG. 5 vary between +1 and +4 bonus laps, the illustrated lap lead bonus card FIG. 5 represents one such card with a lap bonus of +3. Lap lead bonus cards will be defined later.

Figure 6:
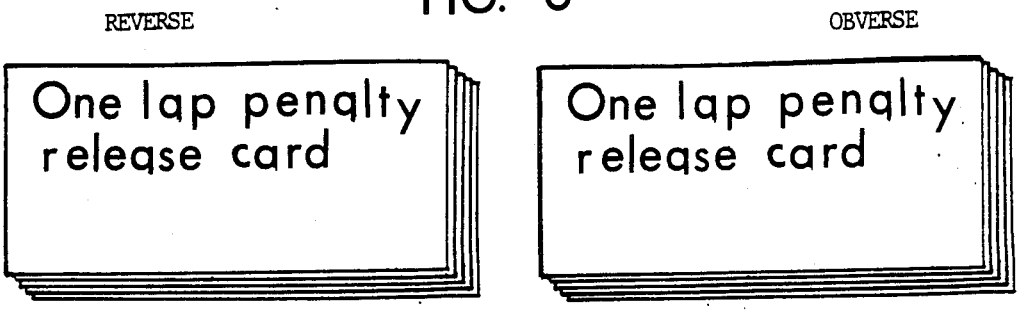
FIG. 6 is a perspective view of a stack of One Lap Penalty Release Cards which bear the same obverse and reverse.
Figure 7:
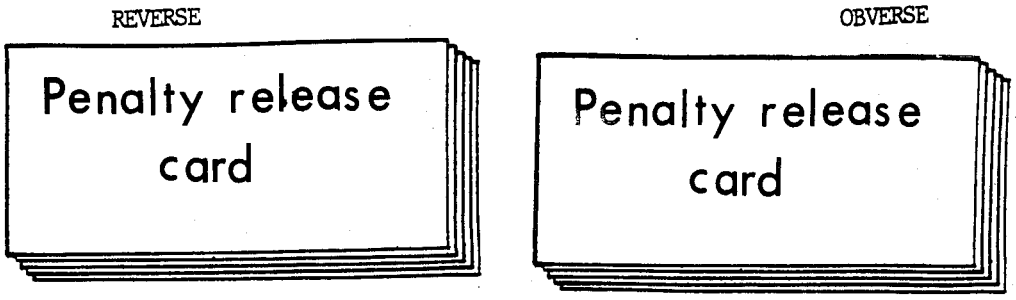
FIG. 7 is a perspective view of a stack of Penalty Release Cards, which bear the same obverse & reverse.

FIG. 7 illustrates the penalty release card. FIG. 6 illustrates the one lap penalty release card. Penalty release cards are acquired by players when in their turn their marker FIG. 2 lands on section 17 of the game board (see FIG. 1A and FIG. 1B) race course 28. In addition penalty release cards FIG. 7 are acquired by participants when in their turn their marker FIG. 2 lands on section 8 of the game board 26 race course 28 and further by all other players voting as to whether or not said player should be granted a penalty release card FIG. 7. Further, a one lap penalty release card FIG. 6 is acquired by a player having his marker land on section 24 of the race course 28.

FIG. 8A and FIG. 8B illustrates the historical record sheet. The historical record sheet FIG. 8A and FIG. 8B illustrates the year 36 of the race, the winning driver(s) 37 the car name 38 the winners average speed 39 and the second place finisher 40. The period covered on the historical record sheet FIG. 8A and FIG. 8B begins in 1911, and continues through the current year.

Procedure for playing the game

Each player in turn throws the dice indicated in FIG. 3 the player who throws the highest number would play first, the second highest player would play second, and so forth. Then beginning with the first player and followed by each other player in their turn, upon throwing the dice shown in FIG. 3 would advance his marker FIG. 2 a number of sections on the race course 28 (see FIG. 1A and FIG. 1B) which would correspond to the total number of dots showing on the dice, FIG. 3 and in compliance with other requirements of the game which follow.

To commence now with the start finish line shown in FIG. 1A at 27, for the first complete circut of the race course 28 shown on FIG. 1A and FIG. 1B each player in his turn is exempt from all penalties. Penalities exist in sections numbered 1, 5, 9, 10, 11, 19, 20, 22, and 23 in the race course 28. Specifics of these penalty sections will be defined later. Sections numbered 2, 3, 12, 13, 14, and 25 in the race course 28 contain indicia providing fo both bonus and penalties. Bonuses are provided for correct answers to question indicia contained within these sections, which would provide for additional advancement of the players marker FIG. 2. Conversely an incorrect answer to question indicia contained within these sections, the player would have to move his marker FIG. 2. backward. Therefore, these sections are considered as bonus/penalty sections. Each of these sections will be individually defined later. During the course of each player completing his first lap around the race course 28 each player in turn whos marker FIG. 2 lands on section 2, 3, 5, 9, 10, 11, 12, 13, 14, 19, 20, 22, 23, or 25, of the race course, 28 while in the process of completing his first lap beginning at the start finish line 27 and until after a complete circuit of the race course 28 when he again crosses the start finish line, 27 each player in his turn for his first lap is exempt from all penalties contained in the indicia in these sections. However during the course of their first lap around the race course, 28 each player in his turn may take advantage of any bonus sections in which his marker FIG. 2 lands. Bonus sections are found on the race course 28 in sections 2, 3, 6, 7, 8, 12, 13, 14, 15, 16, 17, 18, and 25. Specifics of these bonus sections will be defined later.

Beginning the race

The race commences with the first lap as previously described. On all subsequent turns and in conjunction with numbers cast by the dice FIG. 3 each lap after the first lap, each player in turn upon having his marker FIG. 2 land in a section is subject to the directives found in indicia contained in that section. Sections are numbered 1 through 25 on the race course 28 (see FIG. 1A and FIG. 1B).

Specifics of the twenty five sections found on the race course 28 (see FIG. 1A and FIG. 1B) follow.

Section 1, found on the race course 28 (see FIG. 1A and FIG. 1B) states, "Caution Light Do Not Pass For The Next Lap". Section 1, is a penalty section. In the course of playing the game by throwing the dice FIG. 3 each player in his turn whose marker FIG. 3 lands on section 1, of the race course, 28 must limit advancement of his marker FIG. 2 on subsequent turns during the next lap, so as not to pass any other players marker FIG. 2 which may be ahead of his marker FIG. 2. The player may draw his marker FIG. 2 along side of, but not advance beyond any other players marker, FIG. 2 during his subsequent turns in order of play, until he completes one complete lap, ending when his marker FIG. 2 next crosses the start finish line 27.

Section 2, found on the race course 28 (see FIG. 1A and FIG. 1B) is a bonus/penalty section which states, "Name a 2ND Place Winner of Last 10 Years, Correct +5, Wrong −6, Book +1". In the course of playing the game by throwing the dice FIG. 3 each player in his turn whose marker FIG. 2 lands on section 2, must name a second place winner of any race as defined on the history record sheet, FIG. 8A and FIG. 8B at 40, selected from the most current year or any of the nine prior years. In answering, if a player states a correct answer from memory, he may advance his marker FIG. 2 five additional sections, as indicated by correct +5, in section 2, on the race course, 28 and continue or not continue in advancement as may be directed by indicia contained in subsequent sections in which his marker FIG. 2 may land, until his turn is completed. Subsequent sections will be defined later. If a player states a wrong answer from memory as defined on the history record sheet, FIG. 8A and FIG. 8B at 40, or if he fails to answer, he must move his marker FIG. 2 backward six sections as indicated by "Wrong −6", in section 2, on the race course 28 and then play in accordance with indicia found in section 22, on the race course 28. Section 22 will be defined later. Should a player read his answer from the history record sheet, FIG. 8A and FIG. 8B at 40, he then would advance one section as indicated by "Book +1", in section 2, on the race course 28 and then play in accordance with indicia found in section 3 on the race course 28. Section 3 will be defined later. Further, each player is limited to using a second place winning name only one time per game. Other players in ther turn may also use the same name, but only once each for the duration of the game. However, if the same name has placed second in more than one race, as indicated on the history record sheet, FIG. 8A and FIG. 8B at 41, the name may be reused for as many times as the name actually was second. Each other player in their turn may do likewise in their turn if they so choose.

Section 3, found on the race course 28 (see FIG. 1A and FIG. 1B) is a bonus/penalty section which states, "Name a 2ND Place Winner Prior to Last 10 years, Correct +5, Wrong −6, Book +1". In the course of playing the game by throwing the dice FIG. 3 or as the result of advancement from section 2 on the race course, 28 each player in turn whose marker FIG. 2 lands on section 3 must name a second place winner as defined on the history record sheet, FIG. 8A and FIG. 8B at 40 selected from and beginning ten years prior to the current year, and additionally any year preceeding that year. As an example, if the current year is 1985, the player would have to use 1975, or any prior year. Further, each player is limited to using a second place winning name only one time per game. Other players in their turn may also use the same name, but only once each, for the rest of the game. However, if the same name has placed second in more than one race, as indicated on the history record sheet FIG. 8A and FIG. 8B at 42 the name may be reused for as many times as the name actually was second, by each player in their turn if they so choose. If the player states a correct answer from memory he may advance his marker FIG. 2 five additional sections as indicated by, "Correct +5", in section 3, and then be subject to instructions as contained in indicia found in section 8 on the race course 28. Section 8, will be defined later. If the player states a wrong answer from memory, as defined on the history record sheet FIG. 8A and FIG. 8B at 40 or if he fails to answer, he must move his marker FIG. 2 backward six sections as indicated by, "Wrong−6", in section 3, and then play in accordance with indicia found in section 23 on the race course 28. Section 23 will be defined later.

Section 4, found on the race course 28 (see FIG. 1A and FIG. 1B) states, "Short Chute", and is located at Turn #1. This section is considered as a free section, meaning that no bonus or penalty is afforded. In the course of playing the game by throwing the dice FIG. 3 or as the result of advancement from section 18, each player in turn whose marker FIG. 2 lands on section 4 of the race course 28 remains there until his next regular turn. Section 18 will be defined later.

Section 5, is a penalty section found on the race course 28 (see FIG. 1A and FIG. 1B) which states, "Bad Shift Drop Back 5 Sections". In the course of playing the game by throwing the dice FIG. 3 or as the result of penalty from section 12, of the race course, 28 each player in his turn whose marker FIG. 2 lands on section 5, must then further move his marker FIG. 2 backward five sections to the start finish line found at 27 on FIG. 1A and FIG. 1B. He then waits for his next regular turn to continue play. Section 12 will be defined later.

Section 6, found on the race course 28 (see FIG. 1A and FIG. 1B) is a bonus section which states, "Good Turn Proceed 5 Sections". In the course of playing the game by throwing the dice FIG. 3 or as the result of advancement from section 25 on the race course, 28 or as the result of moving backward from section 13, on the race course, 28 each player in turn whose marker FIG. 2 lands on section 6 of the race course 28 proceeds two additional sections to section 8 of the race course 28 and is then subject to instructions as contained in indicia found in section 8. Sections 8, 13, and 25 will be defined later.

Section 7, found on the race course 28 (see FIG. 1A and FIG. 1B) is a bonus section which states, "Good Driving Proceed Five Sections". In the course of playing the game by throwing the dice, FIG. 3 or as the result of advancement from section 2 on the race course, 28 each player in his turn whose marker FIG. 2 lands on section 7, proceeds an additonal five sections to section 12, of the race course 28 and is then subject to instructions as contained in indicia found in section 12. Section 2, has been previously defined, and section 12, will be defined later.

Section 8, found on the race course 28 (see FIG. 1A and FIG. 1B) states, "All Players Vote on Whether or Not to Suspend Your Next Penalty, Short Chute", and is located at turn #2. In the course of playing the game by throwing the dice FIG. 3 or as the result of advancement from section 5, of the race course 28 or by advancement by virtue of pit consequence number 9, found in 35 (see FIG. 1A and FIG. 1B) each player in turn whose marker FIG. 2 lands on section 8 is subject to receiving a penalty release card FIG. 7. In order to actually receive the penalty release card FIG. 7 a vote is required from the other players in the game. In the event of a tie vote, the dice are thrown again. Section 5 has been previously defined. Pit consequence number 9, found in 35 and the penalty release card FIG. 7 will be defined later.

It is now appropriate to define the pit lane 29 (see FIG. 1A and FIG. 1B). As the player progresses his marker FIG. 2 in regular turn as indicated by the dice, FIG. 3 or indicia contained in Note #1 at 39 (which will be defined later) the indicia in each of the race course sections 28 are not applicable for the player while his marker FIG. 2 is in the pit lane 29 or the pits 30. However, once his marker is out of the pits 30 and back on the race course 28 he is subject to indicia contained in which ever section his marker FIG. 2 may land after exiting the pits 30 at section 3. While in the pit lane, 29 the players current lap will only count when his marker FIG. 2 exits the pits, 30 in compliance with 33 on the game board, 26 which states, "For Both Note #1 and Note #2, The Lap to The Pits Will Count As a Regular Lap Upon Exiting The Pits".

Section 9, found on the race course 28 (see FIG. 1A and FIG. 1B) is a penalty section which states, "Oil Leak 4 Turns To Make Pits Note #1". In the course of playing the game by throwing the dice FIG. 3 or as the result of moving backward from section 14, each player in turn whose marker FIG. 2 lands on section 9 is furnter subject to Note #1 found on the inside of the race course 28 at 31. It will now be necessary to explain Note #1 found at 31, which states, "If You Do Not Make Pits In The # Of Turns Specified, Move Only 2 Sections Per Turn Until You Do, Upon Arrival In The Pits Throw For Pit Consequence Number and Follow That Instruction". Section 9, indicia states in part, "4 Turns To Make Pits, Note #1". There fore, in compliance with Note #1, 31 the player moves his marker FIG. 2 to the pit lane 29 located on the inside portion of the race course 28 directly inside section 9. The player then waits for his next regular turn. His marker FIG. 2 will remain in the pit lane for all further play until such time as his marker FIG. 2 reaches the pits 30. In the course of play as indicated in section 9, and in compliance with Note #1, 31 the players marker FIG. 2 must reach the pits, 30 by his fourth regular turn there after in normal succession. If his marker FIG. 2 does not reach the pits 30 by his fourth regular turn, he may there after move only two sections per regular turn, and the dice FIG. 3 are not used until such time as he arrives at the pits. Upon arrival at the pits 30 the player then immediately throws the dice FIG. 3 again in order to find a corresponding pit consequence number 35. The pit consequence numbers 35 range from 2 through 12, and the player must act according to the directive which corresponds to his throw of the dice. For example if he throws the number 3 on the dice, the corresponding pit consequence number is 3, found at 35, which states, "Good Crew Proceed Extra 3 Spaces on Next Turn". The player would then wait for his next regular turn and then move his marker FIG. 2 from the pits 30 onto the main race course 28 at section 3, as indicated by pit exit instructions 34. It is at that time, as indicated at 33 that the current lap counts for the player. He would then throw the dice FIG. 3 and would proceed an equal number of sections as indicated on the dice, and then move three more additional sections in compliance with pit consequence number 3. He would then wait his next regular turn, or continue to play as may be appropriate by the indicia contained in which ever section his marker FIG. 2 may land on the race course 28. Section 14, and the pit consequence numbers will be defined later. The current lap for a player whose marker FIG. 2 has progressed through the pit lane 29 and through the pits 30 and back onto the race course 28 at section 3 is counted at the time that the players marker FIG. 2 is moved onto the race course 28 at section 3.

Section 10, found on the race course 28 (see FIG. 1A and FIG. 1B) is a penalty section which states, "Low on Fuel 3 Turns To Make Pits, Note #1". In the course of playing the game by throwing the dice FIG. 3 each player in turn whose marker FIG. 2 lands on section 10, is further subject to Note #1 found on the inside of the race course 28 at 31. Section 10 indicia states in part, "3 Turns To Make Pits, Note #1". Therefore in compliance with Note #1 the player moves his marker FIG. 2 to the pit lane 29 located on the inside portion of the race course 26 directly inside section 10. The player then waits for his next regular turn. The players marker FIG. 2 will remain in the pit lane for all further play until such time as his marker FIG. 2 reaches the pits 30. In the course of play as indicated in section 10, and in compliance with Note #1 31 the players marker FIG. 2 must reach the pits 30 by his third regular turn in normal succession. If his marker FIG. 2 does not reach the pits 30 by his third regular turn, he may there after move only two sections per his regular turn and the dice FIG. 3 are not used until such time as he arrives at the pits 30. Upon arrival at the pits 30 the player then immediately throws the dice FIG. 3 again in order to find a corresponding pit consequence number 35. He then acts according to the directive of the corresponding pit consequence number 35. The pit consequence numbers 35 range from 2 through 12, and the player must act according to the directive which corresponds to his total shown on the dice FIG. 3. An example is provided in the definition of section 9, which was stated previously. The pit consequence numbers 35 will be defined later.

Section 11, found on the race course 28 (see FIG. 1A and FIG. 1B) is a penalty section which states, "Unfavorable Judges Ruling Return all Penalty Release Cards". In the course of playing the game by throwing the dice, FIG. 3 each player in turn whose marker FIG. 2 lands on section 11, must return to the stack all penalty release cards FIGS. 6 & 7 in his possesion if any. He would then wait for his next regular turn and proceed playing the game. The penalty release cards FIGS. 6 & 7 will be defined later.

Section 12, found on the race course 28 (see FIG. 1A and FIG. 1B) is a bonus/penalty section which states, "Name a 500 Winner Prior To Last 10 Years, Correct +5, Wrong −7, Book + −0". In the course of playing the game by throwing the dice FIG. 3 or as the result of advancement from section 7 each player in turn whose marker FIG. 2 lands on section 12 must name a winner as defined on the history record sheet FIG. 8A & FIG. 8B at 37, selected from and beginning ten years prior to the current year, and additionally any year preceding that year. As an example, if the current year is 1985, the player would have to use 1975 or any prior year. If a player states a correct answer from memory he may advance his marker FIG. 2 five additional sections as indicated by, "Correct +5", in section 12 on the race course 28, and then be subject to instructions as contained in indicia found in section 17. Section 17 will be defined later. If a player states a wrong answer from memory as defined on the history record sheet FIG. 8A & FIG. 8B at 37, or if he fails to answer, he must move his marker FIG. 2 backward seven sections as indicated by "Wrong −7", in section 12, and then play in accordance with indicia found in section 5. If a player reads his answer from the history record sheet FIG. 8A & FIG. 8B he leaves his marker FIG. 2 in section 12 until his next regular turn as indicated by "Book +−0" in section 12. Section 5 and section 7, have been previously defined.

Section 13, found on the race course 28 (see FIG. 1A and FIG. 1B) states, "Name a Winner In Last 10 Years, Correct +5, Wrong −7, Book +−0". In the course of playing the game by throwing the dice FIG. 3 each player in his turn whose marker FIG. 2 lands on section 13 must name a winner of any race as defined on the history record sheet FIG. 8A & FIG. 8B selected from the most current year or any of the nine prior years. If a player states a correct answer from memory, as defined by the history record sheet FIG. 8A & FIG. 8B he may advance his marker FIG. 2 five additional sections as indicated by, "Correct +5", in section 13, on the race course 28. He would then continue to play as indicated By indicia provided in section 18. If a player states a wrong answer from memory as defined on the history record sheet FIG. 8A & FIG. 8B, or if he fails to answer, he must move his marker FIG. 2 backward seven sections as indicated by "Wrong −7", in section 13 on the race course 28, he would then continue to play in accordance with indicia contained in section 6 which was defined earlier.

If a player reads his answer from the history record sheet FIG. 8A & FIG. 8B he leaves his marker FIG. 2 in section 13 as indicated by "Book +−0", in section 13 on the race course 28, and wait until his next regular turn.

Section 14, found on the race course 28 (see FIG. 1A and FIG. 1B) is a bonus/penalty section which states, "Name a Popular 4 Cylinder Engine, Correct +7, Wrong −5, Book +−0". In the course of playing the game by throwing the dice FIG. 3 each player in turn whose marker FIG. 2 lands on section 14, must name a popular 4 cylinder engine, or name any winning car, four cylinder or otherwise as defined on the history record sheet FIG. 8A & FIG. 8B at 38. If the player states a correct answer from memory he may advance his marker FIG. 2 seven additional sections as indicated by, "Correct +7", in section 14 on the race course 28 and advances his marker FIG. 2 to section 21 which represents turn #4 short chute on the race course 28. The player would then wait for his next regular turn to proceed. If the player states a wrong answer from memory he must move his marker FIG. 2 backward five sections as indicated by "Wrong −5", in section 14 on the race course 28. He would then be subject to the instruction indicia in section 9, which was defined earlier. If a player uses the history record sheet FIG. 8A & FIG. 8B at 38 to provide the answer, his marker FIG. 2 would remain in section 14 as indicated by "Book +−0" in section 14 of the race course 28, Section 21 will be defined later.

Section 15, found on the race course 28 (see FIG. 1A and FIG. 1B) is a bonus section which states, "Tail Wind Proceed 3 Sections". In the course of playing the game by throwing the dice FIG. 3 each player in his turn whose marker FIG. 2 lands on section 15, would then proceed an additional 3 sections to section 18, on the race course 28, and would then be subject to instructions as contained in indicia found in section 18. Section 18 will be defined later.

Section 16, found on the race course 28 (see FIG. 1A and FIG. 1B) is a bonus section which states, "Bonus Space Proceed to #4 Short Chute". In the course of playing the game by throwing the dice FIG. 3 each player in his turn whose marker FIG. 2 lands on section 16, would then advance his marker FIG. 2 over the race course 28 directly to turn #4 Short Chute found in section 21 on the race course 28 and then wait for his next regular turn to proceed. Section 21 will be defined later.

Section 17, found on the race course 28 (see FIG. 1A and FIG. 1B) is a bonus section which states, "Bonus Space Draw a Penalty Release Card Turn 3 Short Chute". In the course of playing the game by throwing the dice FIG. 3 or as the result of advancement from section 12, each player in his turn whose marker FIG. 2 lands on section 17 is entitled to draw one penalty release card FIG. 7 and hold the penalty release card FIG. 7 for use at his discretion. Section 12 has been previously defined. The penalty release card FIG. 7 will be defined later.

Section 18, found on the race course 28 (see FIG. 1A and FIG. 1B) is a bonus section which states "Good Driving Proceed to Turn #1 Short Chute". In the course of playing the game by throwing the dice FIG. 3 or as the result of advancement from section 13, each player in his turn whose marker FIG. 2 lands on section 18 would then advance his marker FIG. 2 over the race course 28 directly to turn #1 short chute found in section 4 of the race course 28. Section 13, has been previously defined.

Section 19, found on the race course 28 (see FIG. 1A and FIG. 1B) is a penalty section, which states, "Worn Tire Other Pit Rules Don't Apply Proceed Now To The Pits and Lose Next Turn". In the course of playing the game by throwing the dice FIG. 3 each player in his turn whose marker FIG. 2 lands on section 19, would then advance his marker FIG. 2 over the race course 28 directly to the pits 30. He would then leave his marker FIG. 2 in the pits 30 and miss his next regular turn at play. On his next regular turn after that, the player would then throw the dice FIG. 3 and exit the pits, 30 at which time his current lap would be counted. He would then move his marker FIG. 2 the number of spaces indicated by the dice, beginning with section 3 on the race course, 28 and then play in accordance with the indicia contained in the section in which his marker may land.

Section 20, found on the race course 28 (see FIG. 1A and FIG. 1B) is a penalty section which states, "Bad Fuel Pump Proceed To The Pits Note #2". In the course of playing the game by throwing the dice FIG. 3 or by moving backward from section 25 of the race course 28, each player in his turn whose marker FIG. 2 lands on section 20, would then move his marker to the pit lane 29 on the inside of section 20. He would then wait for his next regular turn.

It is now appropriate to define Note #2 at 32. Note #2 is found on the inside section of the race course 28 (see FIG. 1A and FIG. 1B) at 32. Note #2 states, "You Must Throw On Each of Your Regular Turns Until You Arrive In The Pits Then Wait For Your Next Turn. Do Not Throw For A Pit Consequence Number". A further to Note #1 at 31 and Note #2 at 32 is found on the inside of the pit lane 29 at 33 which states, "For Both Note #1 and Note #2 The Lap To The Pits Will Count As A Regular Lap Upon Exiting The Pits". Therefore as a result of a player having his marker FIG. 2 on the pit lane 29 located to the inside of section 20 on the race course 28, the player would throw the dice for however many regular turns it takes for his marker FIG. 2 to reach the pits 30. Upon arrival at the pits 30 the player would then wait for his next regular turn at which time he would again throw the dice FIG. 3 and re-enter the race course 28 at section 3 at which time his current lap would then be counted. He would then progress his marker FIG. 2 the appropriate number of sections that would correspond with the total on the dice FIG. 3 beginning with section 3. He would then play in accordance with the indicia contained in the section in which his marker FIG. 2 lands.

Section 21, located on the race course 28 (see FIG. 1A and FIG. 1B) states "Short Chute", and is in turn #4 of the race course 28. This section is considered as a free section, meaning that no penalty or bonus is afforded. In the course of playing the game by throwing the dice FIG. 3 or as the result of advancement from sections, 14, or 16, each player in his turn whose marker FIG. 2 lands on section 21 at turn #4 of the race course 28 remains there until his next regular turn.

Section 22 found on the race course 28 (See FIG. 1A and FIG. 1B) states, "You Spun Out Lose Next Turn". This section is a penalty section. In the course of playing the game by throwing the dice FIG. 3 or as the result of a player moving backward from section 2, each player in his turn whose marker FIG. 2 lands on section 22 would remain in section 22 and miss his next regular turn at play. After his missed turn the player would again throw the dice and advance his marker FIG. 2 and be subject to indicia contained in what ever section his marker FIG. 2 may land. Section 2 was defined earlier.

Section 23, found on the race course 28 (see FIG. 1A and FIG. 1B) is a penalty section. Section 23 states, "Judges Penalty Forfeit Lap Lead Cards". In the course of playing the game by throwing the dice FIG. 3 or as the result of a player moving his marker FIG. 2 backward from section 3, each player in his turn whose marker FIG. 2 lands on section 23 must forfeit or return all lap lead bonus cards FIG. 5 which may be in his possession and return them to the lap lead bonus card stack. He would then proceed in regular play on his next regular turn. Lap lead bonus cards FIG. 5 will be defined later. Section 3 was defined earlier.

Section 24 found on the race course 28 (see FIG. 1A and FIG. 1B) is a bonus section. Section 24 states, "You Are Driving Well And Are Exempt From Penalty For One Lap". In the course of playing the game by throwing the dice FIG. 3 each player in his turn whose marker FIG. 2 lands on section 24 is awarded a one lap penalty release card FIG. 6. He then waits for his next regular turn to continue play. The one lap penalty release card FIG. 6 will be defined later.

Section 25, found on the race course 28 (see FIG. 1A and FIG. 1B) is a bonus/penalty section. Section 25 states, "Name a Winning 8 Cylinder Engine, Correct +7, Wrong −5, Book +1". In the course of playing the game by throwing the dice FIG. 3 each player in his turn whose marker FIG. 2 lands on section 25 must name a popular 8 cylinder engine used in a winning race, or name any car, 8 cylinder or otherwise as defined on the history record sheet FIG. 8A & FIG. 8B at 38. If the player states a correct answer from memory he may advance his marker FIG. 2 seven sections to section 6 on the race course 28, as indicated by, "Correct +7", in section 25. The player would then play in compliance with indicia contained in section 6 which was defined earlier. If the player would give a wrong answer from memory, or no answer at all, he would be required to move his marker FIG. 2 backward five sections to section 20 on the race course 28. He would then play in compliance with indicia found in section 20 on the race course 28, which was defined earlier. If the player uses the history record sheet, he would advance his marker FIG. 2 one section to the start finish line 27 on the race course 28. He would then wait for his next regular turn.

Penalty release cards FIG. 7 are held by players to be utalized when their marker FIG. 2 lands on a penalty section. Penalty release cards FIG. 7 are obtained by the player by virtue of his marker FIG. 2 landing on section 8, or section 17, on the race course 28, in compliance with indicia contained in those sections. Sections 8, and 17, were defined earlier. The penalty release card FIG. 7 held by a player can then be used at his option any time during the course of play, that his marker FIG. 2 may land on any penalty section. There is no limit on the number of penalty release cards FIG. 7 which a player may hold. However, if his marker FIG. 2 should land on section 11, on the race course 28, the player would be required to return all penalty release cards FIGS. 6 & 7 which he may posess to the stack. The one lap penalty release card is acquired by the players marker FIG. 2 landing on section 24 of the race course 28 as defined earlier. Penalty release cards FIG. 7 and one lap penalty release cards FIG. 6 are exchanged by the player to release him from penalties indicated in sections in which his marker FIG. 2 may land. The sections in which the penalty release cards FIG. 6 and FIG. 7 may be used are on the race course 28 at sections 1, 5, 9, 10, 19, 20, 22, and 23. The penalty release cards FIGS. 6 and 7, may not be used for release from penalties for wrong answers to questions contained in sections 2, 3, 12, 13, 14, and 25, or for any pit consequence penalties 35. In addition, if the player next in turn is passed the dice FIG. 3 and throws the dice FIG. 3 prior to the preceding player utilizing his penalty release card FIG. 6 or FIG. 7, the preceding player loses his right to use the penalty release card FIG. 6 or FIG. 7, and must suffer the penalty as directed by indicia in the penalty section in which his marker FIG. 2 is placed.

Lap Cards FIG. 4 are placed on or near the playing board 26 (see FIG. 1A and FIG. 1B). Each time a players marker FIG. 2 passes the start finish line on the race course 28, he collects a lap card FIG. 4 which is a way of keeping score of the number of laps the player has completed. In addition someone should be appointed as official score keeper and keep score with paper and pencil.

Lap lead bonus cards FIG. 5 are placed on or near the playing board 26 (see FIG. 1A and FIG. 1B) face side down. Each time the player whose marker FIG. 2 is in the lead of the current lap at the time which it passes over the start finish line 27 on the race course 28, he is entitled to collect a lap lead bonus card FIG. 5 which is drawn off the top of a plurality of said cards which are in a stack. Each lap lead bonus card FIG. 5 bears a single number which will vary among the numbers 1 through 4, among a plurality of lap lead bonus cards. The player whose marker FIG. 2 is first to cross the start finish line 27 on the race course 28 for the current lap, collects a lap lead bonus card FIG. 5. When the total of a players laps around the race course 28 are added to the total of all lap lead bonus cards FIG. 5 which he has accumulated, add up to twenty or more, he would then be the winner of the race. The first player to complete twenty laps of the race course 28 over the start finish line 27 is the winner of the race. In order of succession, the player to finish next with twenty laps across the start finish line 27 would be second, and so forth. When the total of a players laps around the race course 28 are added to the total of all lap lead bonus cards FIG. 5 a player has accumulated, and when that total adds up to twenty or more, then that player would be the winner of the race. It should be noted however, that lap lead bonus cards FIG. 5 can only be taken for credit when added to the regular lap total of a given players laps which in combination add up to twenty or more, at which time said player would be declared the winner. Prior to that time the actual laps completed on the race course 28 by each player, are considered as the actual total laps and lap lead bonus card FIG. 5 points are not relevent. Thus, lap lead bonus cards do not change the status of any laps. They are accredited and added to the actual laps completed only when in combination the total would equal twenty or more. Until that time the lap lead bonus points are irrelevant. Thusly, during the race, lap lead bonus points have no bearing on lap status. Therefore it is possible in the course of the race, for one player to lead a lap on the race course, 28 collect a lap lead bonus card, FIG. 5 and be passed in the next lap by another player, who could in turn then be first across the start finish line 27 and in turn collect a lap lead bonus card FIG. 5.

On the game board 26 (see FIG. 1A and FIG. 1B) on the inside of the pit lane, 29 pit consequence numbers are found at 35. There are eleven pit consequence numbers 35. They begin with number 2 and go through to number 12. When a players marker FIG. 2 arrives at the pits 30 as defined earlier, the player throws the dice FIG. 3 and then proceeds with following the instructions as provided by the number from the eleven pit consequence numbers 35 that corresponds to the number shown on the dice which the player threw. Following are definitions of the eleven pit consequence numbers 35.

Pit consequence number 2 indicates, "Fast Crew Roll On (Throw The Dice Again)". If a player would throw the dice for a pit consequence number and have the number two show, per the indicia in the instructions of number 2, he would throw the dice FIG. 3 again and then move his marker FIG. 2 back onto the race course 28 at section 3, at which time his current lap would count, and then advance his marker a number of sections which would be equal to the number shown on the dice FIG. 3. He would then wait his next regular turn, or continue to play as may be indicated by indicia found in what ever section his marker FIG. 2 may land.

Pit consequence number 3 states "Good Crew Proceed Extra 3 Spaces on Next Turn". A player upon throwing the dice for a pit consequence number and having the number 3 show, would then wait for his next regular turn and then move his marker FIG. 2 from the pits 30 onto the main race course 28 at section 3, as indicated by pit exit instruction 34. It would be at that time that the players current lap would count as indicated at 33 on the game board 26. The player would then throw the dice FIG. 3 and advance his marker FIG. 2 a number of sections which correspond to the numbers on the dice, and then move three additional sections, in compliance with pit consequence number 3. He would then wait his next regular turn, or contunue to play as may be appropriate by the indicia contained in the section in which his marker FIG. 2 may land on the race course 28.

Pit consequence number 4 states, "Poor Crew Performance Drop 4 Spaces On Next Throw". When throwing the dice for a pit consequence number, and have the number 4 show, the player would then wait in the pits 30 for his next regular turn. He would then throw the dice and beginning at section 3 advance his marker FIG. 2 the number of spaces which correspond to the dice. His current lap would count upon exiting the pits 30 onto section 3. Having advanced his marker as indicated by the dice he would then drop back four spaces and wait his next regular turn, or continue to play as may be indicated by indicia contained in which ever section his marker FIG. 2 may land on the race course 28.

Pit consequence number 5, states, "Car Caught Fire Lose Next Throw". Upon throwing the number five on the dice when throwing for a pit consequence number, the player would leave his marker in the pits on his next regular turn and not be allowed to continue to play until the turn after that. He would then proceed in the normal order of play.

Pit consequence number 6, states, "Ignition Problems Lost Next Throw". When throwing the dice for a pit consequence number, and have the number 6 show, the player would leave his marker FIG. 2 in the pits 30 on his next regular turn and not be allowed to play until his turn after. He would then be allowed to proceed in the normal order of play.

Pit consequence number 7, states, "Blown Engine Your Out Of The Race". When throwing the dice for a pit consequence number and having the number 7 show, the player would remove his marker from the game board 26 and would be considered to be out of the game.

Pit consequence number 8, states, "Improved Boost Proceed Double On Your Next Throw". When throwing the dice for a pit consequence number, and have the number 8, show the player would, on his next regular turn, throw the dice, and beginning at section 3 on the race course 28 advance his marker the number of sections which would be double the number shown on the dice. He would then wait his next regular turn, or continue to play, as may be appropriate to indicia contained in which ever section his marker FIG. 2 may land on the race course 28.

Pit consequence number 9, states, "Fast Pit Crew Penalty Suspended Proceed To Turn #2 Short Chute". When throwing the dice for a pit consequence number and having the number 9, show, the player would immediately advance his marker FIG. 2 to turn #2 short chute, which is in section 8 of the race course 28, at which time his current lap would count. He would then be subject to play in compliance with indicia contained in section 8, which was defined earlier.

Pit consequence number 10, states, "Fast Crew Throw Again". When throwing the dice for a pit consequence number, and having the number 10, show, the player would move his marker FIG. 2 to section 3 on the race course 28 and throw the dice again, at which time his current lap would count. He would then advance his marker FIG. 2 the number of sections as shown on the dice and wait for his next regular turn or continue to play as may be indicated by indicia contained in which ever section his marker FIG. 2 lands on the race course 28.

Pit consequence number 11, states, "Major Repairs Lose 2 Throws". When throwing the dice for a pit consequence number, and have the number 11, show the player would wait out his next two regular turns. After not playing for the second turn, on the regular turn after that, the palyer would then throw the dice and advance his marker FIG. 2 to section 3 on the race course 28, at which time his current lap would count. From there he would then advance his marker FIG. 2 a number of sections as indicated on the dice. He would then wait for his next regular turn, or continue to play as may be indicated by indicia contained in what ever section his marker FIG. 2 may land.

Pit consequence number 12, states, "Normal Stop Stay Until Next Throw". When throwing the dice for a pit consequence number, and have the number 12, show, the player would wait out his turn and stay in the pits 30. Then on his next regular turn, he would throw the dice and beginning at section 3 on the race course 28 he would advance his marker FIG. 2 a number of sections as indicated on the dice, at which time his current lap would count. He would then wait for his next regular turn or continue to play as may be appropriate as indicated by indicia contained in what ever section his marker FIG. 2 lands on the race course 28.

It is intended that the patent shall cover by suitable expression in the appended claims, whatever features of patentable novelty exist in the invention disclosed.

What I claim is:

1. A game comprising a board with an oval course having a plurality of marked sections simulating an Indy Class auto race track layout, with a start/finish;

said marked sections providing movement information and certain of said sections including questions concerning knowledge of Indy Class racing, said sections which contain a question having further indicia indicating further player advancement, lesser advancement, and indicia retarding the advancement of the player, said indicia used when a player gives a correct or incorrect answer to said question;

a pit lane following the inner two thirds of the said course and terminating at a specified section.

2. The apparatus of claim 1 including a historical record sheet, which provides a historical chronology of participants and equipment relevant to Indy Class auto racing, corresponding to the historical information of the game.

3. The apparatus of claim 1 including twelve specific pit consequence directives, said pit consequence directives are numbered 2 through 12, further including two dice, upon casting, or throwing the dice, the participant follows the corresponding pit consequence number directive which is the same number as indicated on the dice, thusly these pit consequence directives are arrived at by chance, further specific among said pit consequence directives is a directive which can terminate a participant by indicating "out of race".

4. The apparatus of claim 1, and in addition thereto a plurality of numbered playing pieces simulating Indy Class 500 racers, which are used as playing markers, and two dice which are used to determine player movement.

5. The apparatus of claim 1, and in addition thereto a plurality of cards, each with identical reverse sides, which contain on the face side thereof indicia relating to bonus laps, one of said cards is chosen by a participant who is currently in the lead and crosses the start/finish line, the bonus laps indicated on said chosen card then credited to, the accumulated laps of the participant who is in lead.

6. The apparatus of claim 1, including thereon directives delineating methods of progression pertinent to subject participants with regard to progression to the pit area.

7. The apparatus of claim 1, wherein said movement information includes terminology which is used in Indy Class 500 racing.

* * * * *